US005651462A

United States Patent [19]

Simonsen et al.

[11] Patent Number: 5,651,462

[45] Date of Patent: Jul. 29, 1997

[54] RIGID RECLOSABLE PACKAGING

[75] Inventors: Steven H. Simonsen, Neenah; Richard G. Custer, Appleton, both of Wis.

[73] Assignee: Reynolds Consumer Products Inc., Appleton, Wis.

[21] Appl. No.: 774,309

[22] Filed: Dec. 26, 1996

Related U.S. Application Data

[63] Continuation of Ser. No. 518,210, Aug. 23, 1995, abandoned.

[51] Int. Cl.[6] ..... B65D 1/34

[52] U.S. Cl. ..... 206/557; 383/61

[58] Field of Search ..... 383/61, 63, 94, 383/95, 211; 206/557, 564

[56] References Cited

U.S. PATENT DOCUMENTS

| | | | |
|---|---|---|---|
| 4,673,601 | 6/1987 | Lamping et al. | 428/35 |
| 4,896,775 | 1/1990 | Boeckmann et al. | 206/557 |
| 4,925,318 | 5/1990 | Sorensen | 383/63 |
| 4,949,527 | 8/1990 | Boeckmann et al. | 53/412 |
| 5,188,461 | 2/1993 | Sorensen | 383/63 |
| 5,238,306 | 8/1993 | Heintz et al. | 383/63 X |
| 5,358,334 | 10/1994 | Simonsen | 383/63 |
| 5,366,294 | 11/1994 | Wirth et al. | 383/61 |

*Primary Examiner*—Jacob K. Ackun
*Attorney, Agent, or Firm*—Alan T. McDonald

[57] ABSTRACT

A rigid reclosable package comprises a rigid tray and a flexible cover. The tray includes a bottom, side walls and a flange extending from upper portions of the sides walls and around the periphery of the tray. The flange has a tray opening edge on which a first closure profile is attached. A second closure profile is attached to the flexible cover opposite the first closure profile. The first and second opposing closure profiles are adapted to releasably engage each other. The cover is permanently attached to the flange except along the tray opening edge.

17 Claims, 3 Drawing Sheets

RIGID RECLOSABLE PACKAGING

This application is a continuation of application Ser. No. 08/518,210 filed Aug. 23, 1995, and now abandoned.

FIELD OF THE INVENTION

The present invention generally relates to rigid reclosable packaging and, more particularly, to a package having a rigid tray portion and a flexible covering sealed on the tray portion.

BACKGROUND OF THE INVENTION

Reclosable packages are widely used in the packaging of a variety of products, especially food. Reclosable packages are convenient in that after the initial opening, consumers can close and reseal the package to better preserve the enclosed contents. A critical factor in preserving the contents of any package is the integrity of the seals. Air and water tend to migrate more readily in packages having non-permanent seals. Thus, it is most desirable to use permanent seals wherever a seal is needed and a limited number of non-permanent seals.

Rigid packages are often utilized when the contents could be easily crushed or broken. Rigid packages provide structural support to protect the contents of the package such that the contents remain intact during transportation, storage, and handling. However, unlike a flexible package, the opening of a rigid package cannot be expanded by distorting the package due to the rigidness of the package. Thus, rigid reclosable packages generally have used a lid or cover which is removed when accessing the contents. But since these lids or covers employ non-permanent seals, the rigid package is more susceptible to the permeation of air and moisture after being reclosed.

Many packages use non-permanent, reclosable seals at the opening of the package. In one technique, the reclosable seal includes male and female closure profiles disposed on opposing surfaces of the package and configured to releasably interlock with each other. The male and female portions can be integral with the opposing surfaces, or nonintegral with the opposing surfaces but adhering thereto. The adherence of the male and female profiles is typically achieved by means of heat fusion. In another technique, the reclosable seal is a pressure-sensitive adhesive at opposing surfaces of the package adjacent the entrance.

U.S. Pat. No. 5,358,334 to Simonsen discloses a reclosable profile strip for packages which eliminates slippage between the two web portions of the profile strip. The reclosable profile strips are designed primarily for flexible packages.

U.S. Pat. Nos. 4,896,775 and 4,949,527 to Boeckman et al. disclose a reclosable tray for foodstuffs which encases its contents with a cover sealed to a rim of the tray through heat sealing or adhesives. Both the cover and the tray are flexible. A male and female interlocking connection lies between the cover and rim on one side of the tray. The cover can be pulled back such that the seal on the rim of the two sides adjacent the side having the male and female interlocking connection is detached and the contents of the package are revealed. The problem with this arrangement is that the two sides with the detached seal allow for the access of air and water when the package is closed after the initial opening.

A similar package is disclosed in U.S. Pat. Nos. 5,188,461 and 4,925,318 to Sorenson. In these patents, at least one side of a cover sheet has a peel seal weld attaching the cover sheet to a flange of a cup. Thus, this cover sheet can be pealed away to access the contents of the cup. Additionally, male and female reclosable interlocking portions exist on one side of the flange of the cup. Again, if the cover is pealed back slightly and resealed with the interlocking portion, air and water still may access the contents of the cup on those sides which are peeled back and have no reclosable interlocking portions.

A need therefore exists for a rigid reclosable package arrangement which overcomes the aforementioned shortcomings associated with the migration of air and water into the rigid package while still allowing access to the contents of the package.

SUMMARY OF THE INVENTION

In one particular embodiment, the present invention provides a reclosable rigid tub, or tray, with a flexible cover. The tray has a bottom, side walls and a flange extending around the periphery of the tray at an upper portion of the side walls. The cover is a flexible polymeric film which is permanently sealed to the flange except at a tray opening edge from which the contents of the package are removed. At the tray opening edge, a reclosable interlocking seal exists between the flange and the cover. The interlocking seal includes first and second closure profiles permanently attached to the cover and flange, respectively. The first closure profile has a male locking portion while the second closure profile has a female locking portion for releasably engaging the male locking portion. In one embodiment, an additional frangible seal is adjacent the interlocking seal to reduce the likelihood of spoilage prior to the initial opening of the package by a consumer.

In another embodiment, the female locking portion of the interlocking seal is integral with the flange of the tray. The female locking portion is generally in the form of a slot extending along the tray opening edge. This embodiment is advantageous in that less material is needed to form the female portion.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
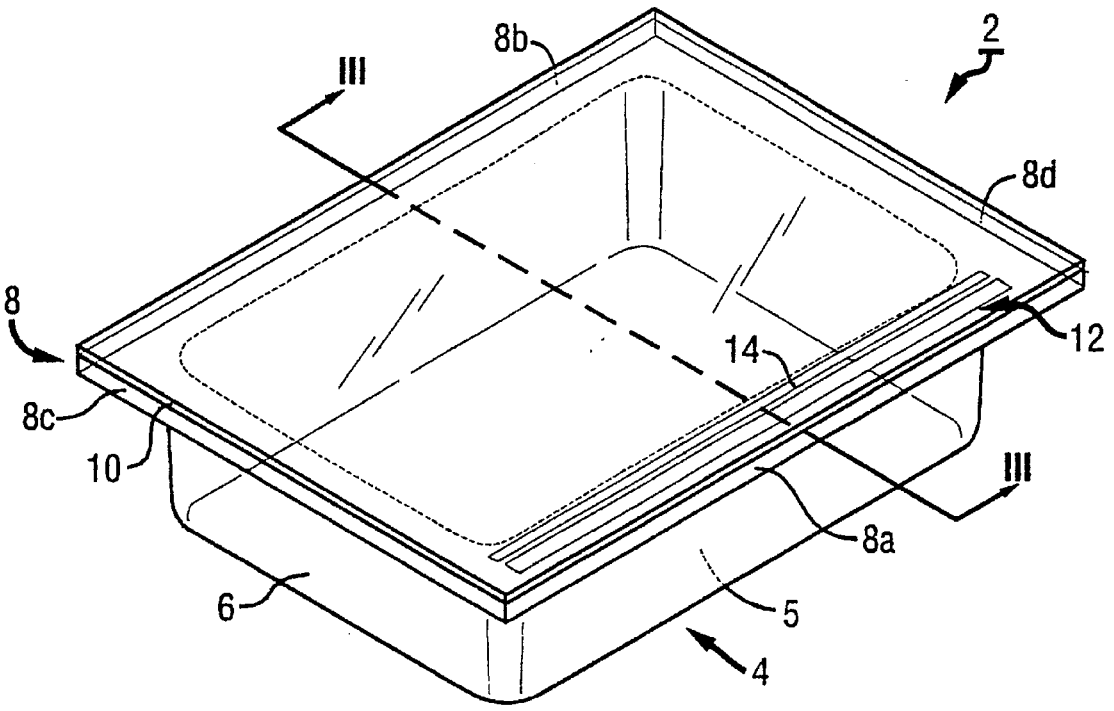
FIG. 1 is a perspective view of a reclosable package embodying the present invention with the cover in the closed position.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Figure 2:
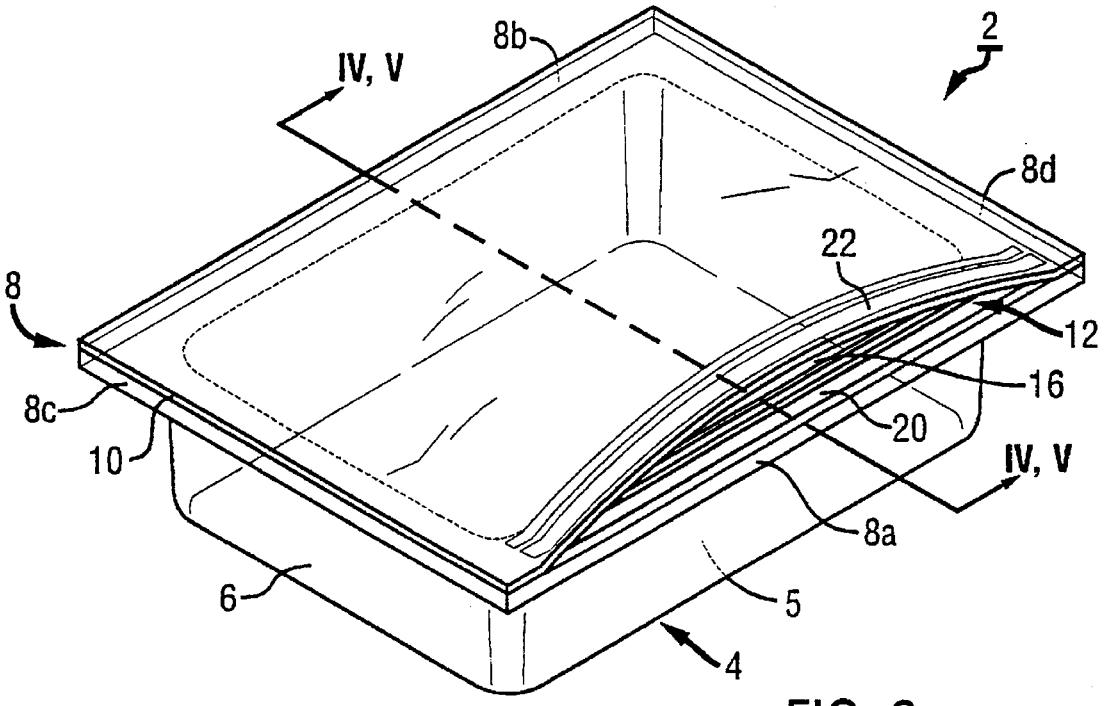
FIG. 2 is a perspective view of a reclosable package embodying the present invention with the cover in the opened position.

Turning now to the drawings, FIGS. 1 and 2 are perspective views depicting a reclosable package 2 with its entrance closed and opened, respectively. In FIG. 1, the reclosable package 2 is illustrated with a tray 4 having a bottom 5 and four sides 6. The tray 4 has a flange 8 including flange portions 8*a*, 8*b*, 8*c*, and 8*b* which extend around the periphery of the tray 4. A flexible cover 10 is positioned over the tray 4 and permanently sealed to flange portions 8*b*, 8*c*, and 8*d*. A reclosable interlocking closure 12 is disposed between flange portion 8*a* and the cover 10. Additionally, a frangible, or breakable, seal 14 is adjacent the reclosable interlocking closure 12 to further restrict access of air and water to the contents of the reclosable package 2. Generally, this frangible seal 14 is a peal seal or a tear seal which a consumer can open manually by use of his or her hands. Although the frangible seal 14 is shown inward of the interlocking closure 12 in FIGS. 1 and 2, the frangible seal 14 can also be located outward of the interlocking closure 12.

The tray 4 is made from a polymeric material with a thickness providing for a rigid, or at least semi-rigid, reclosable package 2. When formed into the configuration of FIG. 1, the tray 4 has a substantial resistance to torsional and bending stresses thereby protecting the contents of the reclosable package 2. Generally, the tray 4 is made from a polystyrene sheet with a thickness in the range from about 0.005 inches to about 0.020 inches which adequately resists typical transportation stresses and handling stresses from a consumer. The polystyrene material generally has a tensile modulus from about 400,00 psi to about 500,000 psi. To add extra rigidity to the tray 4, strengthening ribs or other common reinforcing structure are added to the side walls 6. The tray 4 can also be made of polypropylene, polyester or high density polyethylene with thicknesses providing for adequate rigidity. In most cases, the tray 4 is manufactured through common techniques such as thermoforming, injection molding, or blow molding. In addition to polymers, the tray 4 can also be made from other material such as a metal with coatings on the flange 8 to allow for bonding to the polymeric cover 10.

The cover 10 is a thin film polymer material which provides flexibility. Generally, the cover 10 is less than 0.006 inches thick and is comprised of multiple layers of polymeric materials. A sealant layer allows the cover 10 to be sealed to the flange 8. A barrier layer enhances the ability of the cover 10 to prevent air and water exchange between the contents and the ambient environment. And, a base layer acts as the primary bulk layer to the multilayer cover 10. Generally, the sealant layer is made from low density polyethylene, ethyl vinyl acetate, or SURLYN (metal salt of an ethylene acid copolymer) from Du Pont Company of Wilmington, Del. with a thickness in the range from about 0.0002 inches to about 0.0025 inches. The barrier layer is typically ethyl vinyl alcohol, BAREX (acrylonitrile methyl acrylate) from BP Chemicals of Cleveland, Ohio, or SARAN (polyvinylidene chloride copolymer) from Dow Chemical Inc. of Midland, Mich. with a thickness in the range from about 0.00002 inches to about 0.0005 inches. The base layer is generally a polyester, polypropylene, or nylon with a thickness in the range from about 0.00048 inches to about 0.00125 inches.

The permanent seal between the tray 4 and the flexible cover 10 is generally a weld seal, as it is known to those skilled in the art. This type of seal is characterized in that the materials being joined, here the cover 10 and tray 4, will destruct before the seal is broken. Thus, on flange portions 8*b*, 8*c*, and 8*d*, the movement of air and moisture through the seal into the contents is held to a minimum.

FIG. 2 illustrates the reclosable package 2 in its opened state. The cover 10 is pulled upward near the interlocking closure 12 by a consumer. Two portions of the interlocking closure 12, the female closure profile 20 on the flange portion 8*a* and the male closure profile 22 on the cover 10, then separate. The separation of the female closure profile 20 from the male closure profile 22 creates an entrance 16 to the reclosable package 2. The cover 10 remains in contact with flange portions 8*b*, 8*c*, and 8*d* of the tray 4 due to the strength of the permanent seal.

The size of the entrance 16 is limited since the cover 10 remains in contact with the flange 8 adjacent the ends of interlocking closure 12 near flange portions 8*c* and 8*d*. However, the flexibility of the cover 10 allows for a slight amount of expansion of the entrance 16. The consumer then slides his or her fingers through the entrance 16 to remove the contents, or allows the contents to fall from the tray 4 through the entrance 16 by gravity. Alternatively, the consumer may use a tool, such as a spoon, to access the contents of the reclosable package 2. As the length of the interlocking closure 12 along flange portion 8*a* increases, the size of the entrance 16 increases. Additionally, the degree of flexibility of the cover 10 has an effect on the size of the entrance 16.

After the consumer has removed the desired amount of product from the reclosable package 2, the consumer applies pressure to the cover 10 over the interlocking closure 12. The male closure profile 22 engages the female closure profile 20 and the reclosable package 2 is resealed to inhibit the passage of air and moisture into the contents.

Figure 3:
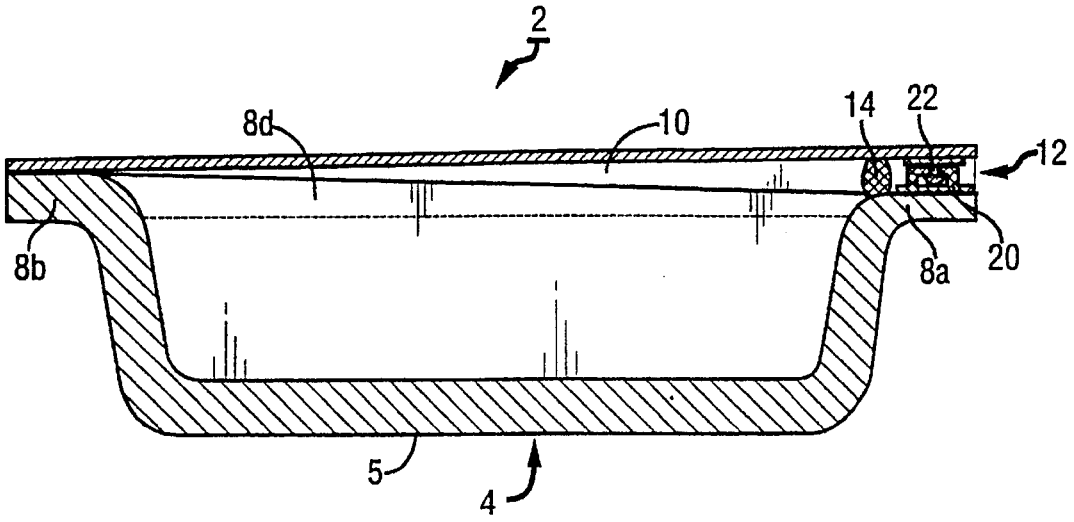
FIG. 3 is a sectional view taken along line III—III in FIG. 1.

FIG. 3 shows a cross-sectional view of the reclosable package 2 in which the cover 10 is in the closed position. The interlocking closure 12 is now shown in detail with its two portions, the female closure profile 20 and the male closure profile 22. Here, the female closure profile 20 and male closure profile 22 are nonintegral pieces which have been attached to flange portion 8*a* and cover 10, respectively. The frangible seal 14 is also shown inward of the interlocking closure 12 between flange portion 8*a* and the cover 10. Because the frangible seal 14 is intact, this illustration reflects the state of the reclosable package 2 before the consumer has initially opened it.

Figure 4:
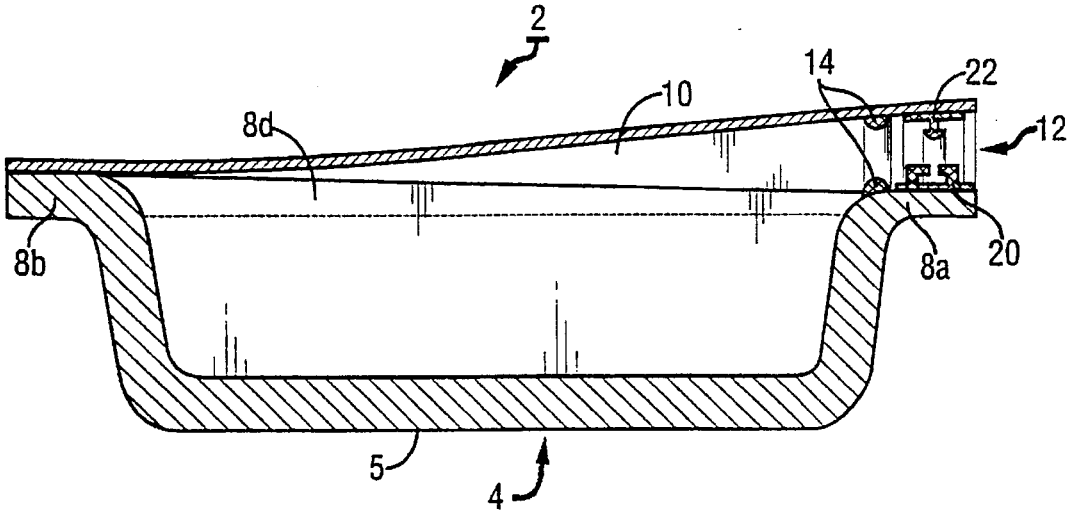
FIG. 4 is a sectional view taken along line IV—IV in FIG. 2.

In FIG. 4 shows a cross-sectional view of the reclosable package 2 in which the cover 10 is in the opened position. The male closure profile 22 has been separated from the female closure profile 20 and the frangible seal 14 has been broken with part of the frangible seal 14 remaining on the cover 10 while some remains on flange portion 8*a*. This view also illustrates the cover 10 remaining attached to flange portions 8*b* and 8*d* although the cover 10 is being pulled upwardly along the interlocking closure 12.

Figure 5:
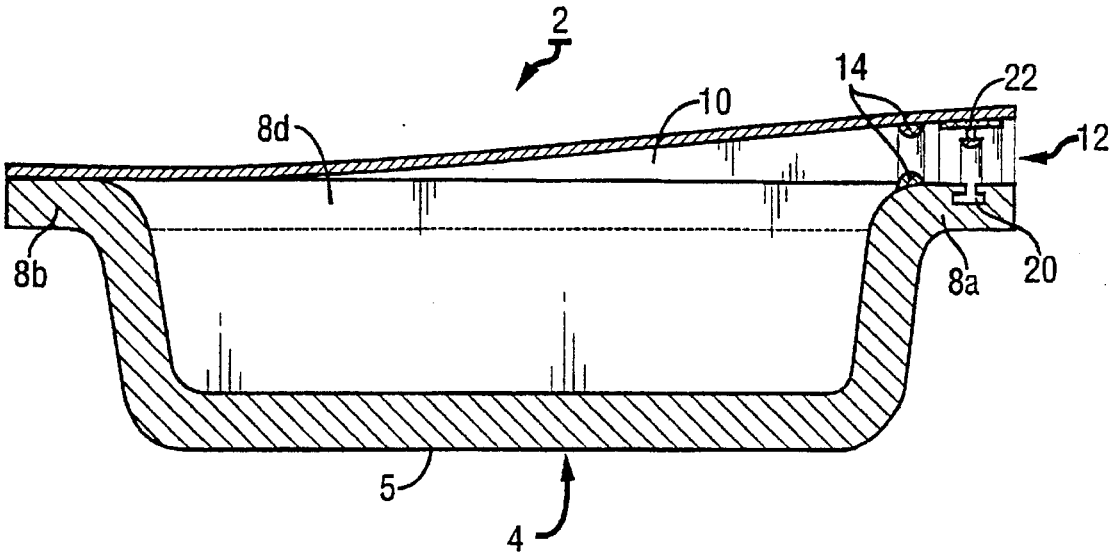
FIG. 5 is a sectional view taken along line V—V in FIG. 2 in which the female locking closure is integral with the flange.

An alternative embodiment is shown in FIG. 5. FIG. 5 is similar to FIG. 4 except the female closure profile 20 is now incorporated into flange portion 8*a*. As with the previous embodiment, the male closure profile 22 releasably engages the female closure profile 20. The benefit to this arrangement is that less material is used to form female closure profile 20.

While the present invention has been described with reference to one or more particular embodiments, those skilled in the art will recognize that many changes may be made thereto without departing from the spirit and scope of the present invention.

For example, the interlocking portion 12 may be designed in a different shape or include lateral posts to maintain the alignment of the male and female closure profiles 22 and 20. Additionally, a resealable adhesive material may be used instead of the male and female closure profiles 22 and 20 to close and reseal the reclosable package 2.

Furthermore, the interlocking closure 12 may be designed with other types of interlocking closure profiles well known in the art. The male closure profile 22, for instance, may include additional locking members, and the female closure profile 20 may include additional locking members adapted to engage with these additional locking members on the male closure profile 22.

Each of these embodiments and obvious variations thereof is contemplated as falling within the spirit and scope of the invention, which is set forth in the following claims.

What is claimed is:

1. A rigid reclosable package, comprising:

a rigid tray having a bottom and connected side walls extending upwardly from said bottom, said side walls and said bottom defining a cavity for holding contents of said rigid reclosable package, said tray having a flange extending from upper portions of said side walls and around the periphery of said tray, said flange having a tray opening edge;

a flexible cover positioned over said cavity and said flange;

first and second opposing closure profiles adapted to releasably engage each other, said first closure profile being applied directly to said flange at said tray opening edge and said second closure profile being applied directly to said cover opposite said first closure profile, said cover being permanently sealed to said flange except at said tray opening edge; and a frangible seal formed of a peal seal material applied directly to said cover and to said flange, said frangible seal spaced from said first and second closure profiles and positioned between said first and second closure profiles and said cavity, said frangible seal attaching said cover to said flange at said tray opening edge, said frangible seal being broken by a consumer during initial opening of said rigid reclosable package, said first and second closure profiles and the portion of said tray opening edge opposite said first and second closure profiles from said frangible seal being free from peel seal material.

2. The rigid reclosable package of claim 1, wherein said first closure profile includes a first base strip attached to said flange at said tray opening edge and a first locking member extending upwardly toward said second closure profile from said first base strip, and wherein said second closure profile includes a second base strip attached to said cover and a second locking member extending downwardly toward said first closure profile from said second base strip, said second locking member being releasably engageable with said first locking member.

3. The rigid reclosable package of claim 2, wherein the first closure profile includes a third locking member spaced from said first locking member and extending upwardly toward said second closure profile from said first base strip, said second locking member being releasably engageable between said first and third locking members.

4. The rigid reclosable package of claim 1, wherein said cover is comprised of multiple polymeric films.

5. The rigid reclosable package of claim 4, wherein said cover has first, second, and third films, said first film being a sealant film for adhering to said flange, said second film being a barrier film for inhibiting permeation of air and moisture through said cover into said tray, and said third film being a base film for strengthening said cover.

6. The rigid reclosable package of claim 5, wherein said sealant film is made of a material selected from the group consisting of polyethylene, ethyl vinyl acetate, and metal salt of an ethylene acid copolymer.

7. The rigid reclosable package of claim 5, wherein said barrier film is made of a material selected from the group consisting of ethyl vinyl alcohol, acrylonitrile methyl acrylate, and polyvinylidene chloride copolymer.

8. The rigid reclosable package of claim 5, wherein said base film is made of a material selected from the group consisting of polypropylene, polyester, and nylon.

9. The rigid reclosable package of claim 5, wherein said sealant film is made from polyethylene, said barrier film is made from ethyl vinyl alcohol, and said base film is made from polypropylene.

10. The rigid reclosable package of claim 6, wherein said sealant film has a thickness ranging from about 0.0002 inches to about 0.0025 inches.

11. The rigid reclosable package of claim 7, wherein said barrier film has a thickness ranging from about 0.00002 inches to about 0.0005 inches.

12. The rigid reclosable package of claim 8, wherein said base film has a thickness ranging from about 0.00048 inches to about 0.00125 inches.

13. The rigid reclosable package of claim 9, wherein said sealant film has a thickness ranging from about 0.0002 inches to about 0.0025 inches, said barrier film has a thickness ranging from about 0.00002 inches to about 0.0005 inches, and said base film has a thickness ranging from about 0.00048 inches to about 0.00125 inches.

14. The rigid reclosable package of claim 1, wherein said tray is made of a material selected from the group consisting of polypropylene, polystyrene, polyester, and high density polyethylene.

15. The rigid reclosable package of claim 14, wherein said tray has a thickness ranging from about 0.005 inches to about 0.020 inches.

16. The rigid reclosable package of claim 1, wherein said tray is made from a material with a tensile modulus in the range from about 400,00 psi to about 500,000 psi.

17. The rigid reclosable package of claim 1, wherein said side walls includes four side walls and said tray is generally rectangular in shape.

* * * * *